US007187280B2

(12) United States Patent
Ko

(10) Patent No.: US 7,187,280 B2
(45) Date of Patent: Mar. 6, 2007

(54) ALARM SYSTEM WITH THIN PROFILE

(75) Inventor: Joseph Y. Ko, Laguna Niguel, CA (US)

(73) Assignee: Techko, Inc., Irvine, CA (US)

( * ) Notice: Subject to any disclaimer, the term of this patent is extended or adjusted under 35 U.S.C. 154(b) by 271 days.

(21) Appl. No.: 10/903,330

(22) Filed: Jul. 30, 2004

(65) Prior Publication Data

US 2005/0068176 A1 Mar. 31, 2005

Related U.S. Application Data

(60) Provisional application No. 60/491,391, filed on Jul. 31, 2003.

(51) Int. Cl.
*G08B 13/08* (2006.01)

(52) U.S. Cl. ..... 340/545.2; 340/547; 340/521; 340/693.5

(58) Field of Classification Search ..... 340/547, 340/545.2, 521, 693.5, 541, 545.1, 545.5; 200/61.7–61.73, 61.45 R, 61.45 M; 335/207, 335/205, 206

See application file for complete search history.

(56) References Cited

U.S. PATENT DOCUMENTS 4,319,228 A 3/1982 Daniels
4,327,359 A 4/1982 Kurtz
4,438,430 A 3/1984 Young et al.
4,677,424 A 6/1987 Hollinger
4,847,719 A 7/1989 Cook et al.
4,864,087 A 9/1989 Chen
4,910,634 A 3/1990 Pipkorn
4,962,602 A * 10/1990 Meyrowitsch ..... 40/541
5,164,705 A 11/1992 Dunagan et al.
5,353,015 A 10/1994 Robinson
5,554,833 A 9/1996 Johnson
5,576,678 A 11/1996 Saunders
6,078,050 A * 6/2000 Castleman ..... 250/339.15
6,278,367 B1 * 8/2001 Baglin ..... 340/546
6,570,508 B1 * 5/2003 Kvenvold ..... 340/870.17
6,989,746 B2 * 1/2006 Rasmussen ..... 340/541

* cited by examiner

*Primary Examiner*—Anh V. La
(74) *Attorney, Agent, or Firm*—Knobbe Martens Olson & Bear LLP

(57) ABSTRACT

An alarm system includes a housing that substantially encloses a plurality of sensors and an alarm-signal generator. The housing has a thin profile and may be mountable in various locations, such as on a window surface. The thin profile of the housing allows the alarm system to be attached to the surface of a first window and capable of being located between the first window surface and a second window surface upon relative motion between the first window surface and the second window surface.

8 Claims, 9 Drawing Sheets

ALARM SYSTEM WITH THIN PROFILE

REFERENCE TO RELATED APPLICATION

This application claims the benefit of priority under 35 U.S.C. § 119(e) of U.S. Provisional Application No. 60/491,391, filed on Jul. 31, 2003, and entitled "ALARM SYSTEM WITH THIN PROFILE," the entirety of which is incorporated herein by reference.

BACKGROUND OF THE INVENTION

1. Field of the Invention

Embodiments of the present invention relate generally to alarm systems, and more particularly, to alarm systems having a thin profile.

2. Description of the Related Art

Alarm systems generally are used to secure an area from unwanted intrusion. For example, alarm systems are often found in dwellings, places of business, and other locations where safety is a concern or where the protection of personal property is desired. Typically, an alarm system triggers a perceptible signal, such as a sound or a light, when the area protected by the alarm system has been breached. Conventional alarm systems use sensors, such as motion sensors, to detect the breaches of security. Oftentimes, these breaches of security occur through entryways, such as a door of a building, or through windows.

Conventional alarm systems often include components that are large, unsightly, or obstructive. For example, alarm systems that are installed to monitor the security of a window often require components that must be affixed to the window and/or window pane and that obstruct the relative movement of window surfaces. In addition, typical alarm systems require that physical modifications, such as the drilling of holes, be made to a window or surrounding area to install components of the alarm system. Furthermore, conventional alarm systems often include wiring or unsightly components connecting sensors to a central monitoring system.

Such conventional alarm are often difficult to install or maintain and can require significant labor during installation or maintenance of the system. This often increases the cost of purchasing, installing, and/or maintaining the alarm system.

SUMMARY OF THE INVENTION

Embodiments of the invention improve upon conventional alarm systems with the use of a plurality of sensors and a housing having a thin profile. Features of embodiments of the invention allow for unobstructed use of a secured window, quick and easy installation and maintenance, and reduced manufacturing and production costs over conventional alarms.

In one embodiment, an alarm system includes a vibration sensor, a magnetic sensor, a speaker, control circuitry, and a housing. The vibration sensor senses vibration of the alarm system and is configured to output a first signal upon sensing the vibration. The magnetic sensor is configured to sense changes in distance between the alarm system and a signal-generating device and is configured to output a second signal upon sensing the changes in distance. The control circuitry is coupled to the vibration sensor, to the magnetic sensor, and to the speaker, and is configured to cause an audible alarm through the speaker in response to receiving the first signal or the second signal. The housing substantially encloses the vibration sensor, the magnetic sensor, the speaker, and the control circuitry, and comprises a thin profile. For example, the thin profile of the housing allows the alarm system to be attached to a first window surface such that the housing is capable of being located between the first window surface and a second window surface upon relative motion between the first window surface and the second window surface.

In another embodiment of the invention, a self-contained alarm system includes a plurality of sensors, an alarm-signal generator, and a housing. The plurality of sensors and the alarm signal generator are disposed within the housing. In addition, the housing comprises a thin profile and is mountable on a first window surface such that the housing is capable of being located between the first window surface and a second window surface upon relative motion between the first window surface and the second window surface.

In another embodiment of the invention, a self-contained alarm system comprises a plurality of sensors, an alarm-signal generator, and a housing, wherein the plurality of sensors and the alarm signal generator are disposed within the housing, and wherein the housing comprises a profile of less than about 0.5 inch.

In another embodiment, an alarm system comprises a plurality of means for sensing, a means for generating an alarm signal, and a means for housing the plurality of means for sensing and the means for generating an alarm signal. The means for housing comprises a thin profile and is mountable on a first window surface such that the means for housing is capable of being located between the first window surface and a second window surface upon relative motion between the first window surface and the second window surface.

In another embodiment, a method of installing a security device on a window assembly comprises: attaching a signal-generating element to a first location of a window assembly having a first window and a second window, wherein the surfaces of the first window and the second window are in substantially parallel planes; and attaching a self-contained alarm system to the surface of the first window, wherein the alarm system is configured to sense a signal emitted by the signal generating element, and wherein the alarm system comprises a thin profile and is capable of being located between the first window surface and the surface of the second window upon relative motion between the first window surface and the second window surface.

For purposes of summarizing the invention, certain aspects, advantages and novel features of the invention have been described herein. It is to be understood that not necessarily all such advantages may be achieved in accordance with any particular embodiment of the invention. Thus, the invention may be embodied or carried out in a manner that achieves or optimizes one advantage or group of advantages as taught herein without necessarily achieving other advantages as may be taught or suggested herein.

DETAILED DESCRIPTION OF THE PREFERRED EMBODIMENT

The features of embodiments of the invention will now be described with reference to the drawings summarized above. Throughout the drawings, reference numbers are re-used to indicate correspondence between referenced elements. The drawings, associated descriptions, and specific implementation are provided to illustrate embodiments of the invention and not to limit the scope of the invention.

In addition, methods and functions described herein are not limited to any particular sequence, and the blocks or states relating thereto can be performed in other sequences that are appropriate. For example, described blocks or states may be performed in an order other than that specifically disclosed, or multiple blocks or states may be combined in a single block or state.

Figure 1:
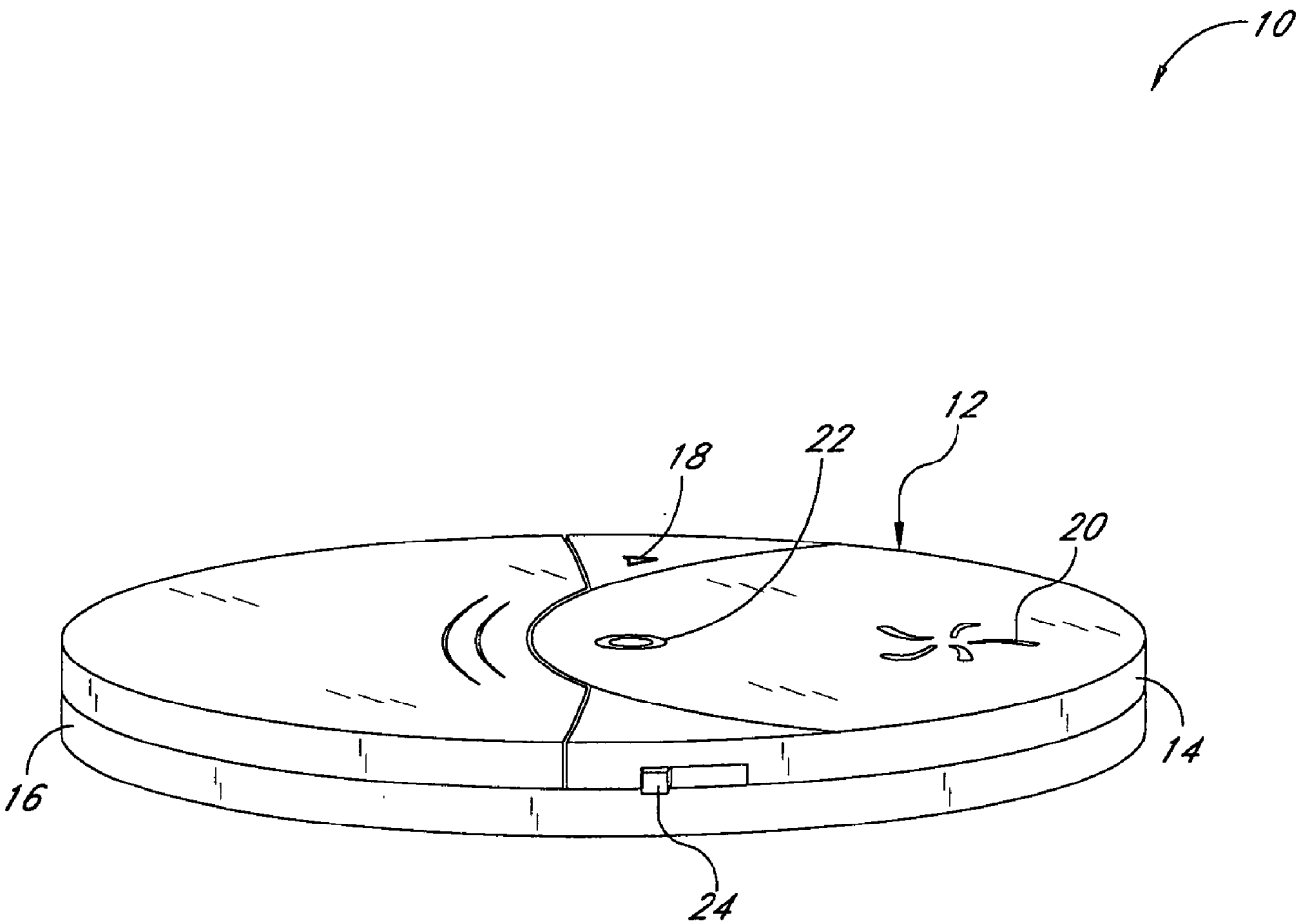
FIG. 1 illustrates a perspective view of one embodiment of an alarm system having a thin profile.

FIG. 1 illustrates one embodiment of an alarm system 10. The alarm system 10 comprises a housing 12 having an upper portion 14 and a lower portion 16. The housing 12 is structured to enclose at least a portion of alarm circuitry, which is described in more detail with reference to FIG. 4.

In certain embodiments of the invention, the housing 12 advantageously has a thin profile. The term "profile" as used herein is a broad term and is used in its ordinary sense and includes without limitation the thickness of at least one dimension of the alarm system 10. For example, the term "profile" may relate to the width, length, and/or height of the housing 12 of the alarm system 10.

A thin profile advantageously facilitates placement of the alarm system 10 in locations with limited space, such as between windows. For example, in one embodiment, the housing 12 preferably has a profile of approximately 0.5 inch (1.27 centimeters) or less. In other embodiments, the housing 12 has a profile of approximately 0.375 inch (0.95 centimeters) or less. In yet other embodiments, the housing 12 advantageously has a profile of approximately 0.25 inch (0.635 centimeters) or less. In other embodiments of the invention, the housing 12 may have a profile of greater than 0.5 inch.

In one embodiment, the upper portion 14 is coupled to the lower portion 16. The upper portion 14 may be marked with a symbol 18 that indicates to a user the proper orientation of the alarm system 10. For example, the alarm system 10 may need to be oriented in a particular direction in order to function correctly (e.g., internal sensors may require a certain orientation). In one embodiment, the symbol 18 is an arrow. In other embodiments, the symbol 18 may comprise words, characters, illustrations, indentations, or the like that indicate to the user the proper positioning of the alarm system 10. In other embodiments of the invention, the alarm system 10 is not orientation-dependent.

In one embodiment, the upper portion 14 defines one or more vents 20. The vents 20 advantageously provide a location for sound, such as that created by the alarm circuitry or an alarm-signal generator, to escape from the housing 12. The upper portion 14 may also define an indicator opening 22 that permits viewing of an indicator, such as a light, that displays the status of the alarm system 10. For example, the indicator may display whether the alarm system 10 is activated or deactivated, or may display the battery status of the alarm system 10.

The alarm system 10 also comprises a control switch 24. In one embodiment, the control switch 24 preferably is coupled with the alarm circuitry and extends through an opening in the upper portion 14 of the housing 12. The control switch 24 preferably has a plurality of positions. For example, the control switch 24 may comprise an "OFF" position that indicates when the alarm system 10 is deactivated. The control switch 24 may also comprise a plurality of decibel-level positions that indicate the loudness of an alarm signal emitted or caused by the alarm system 10. In one embodiment of the invention, the control switch comprises a 70-decibel position and a 90-decibel position. In other embodiments, another number of levels may be used or the magnitude of the decibel options may differ. When the control switch 24 is in one of the plurality of decibel positions, the alarm system 10 preferably is activated, and upon being triggered, the alarm system 10 sounds an audible alarm at the selected decibel level.

It is contemplated that in other embodiments of the invention the control switch 24 may take on forms or configurations other than a switch. For example, the control switch 24 may comprise a rotatable knob that allows for a continuous range of possible outputs. In other embodiments, the control switch 24 may comprise a touch screen, a sliding control, or other interface that allows for a user to select between different modes of operation of the alarm system 10.

Figure 2:
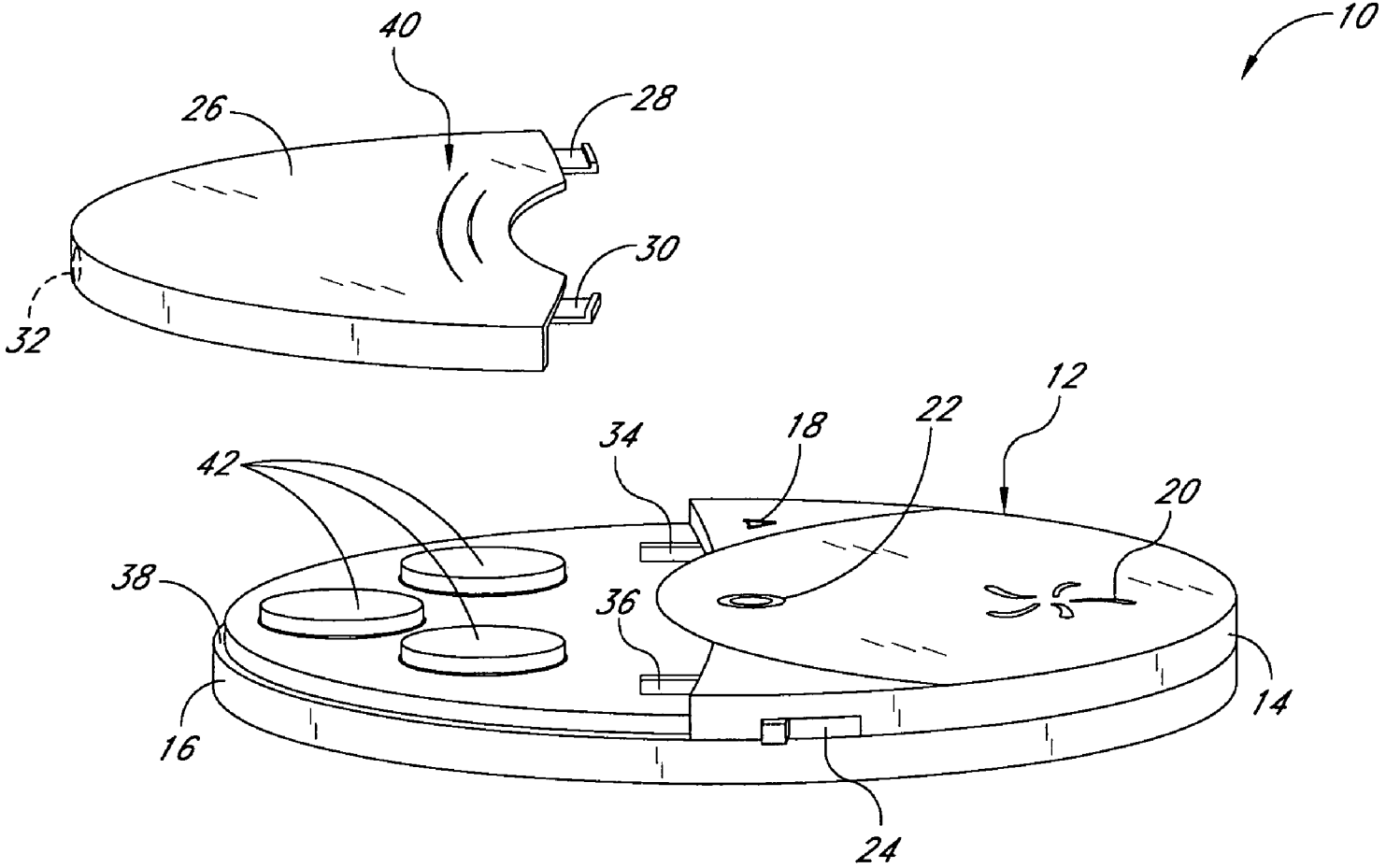
FIG. 2 is an exploded perspective view of one embodiment of the alarm system.

FIG. 2 illustrates an embodiment of the invention wherein the upper portion 14 further comprises a removable portion 26. The removable portion 26 comprises a plurality of tabs 28, 30, 32 that communicate with a plurality of slots 34, 36, 38 defined in the lower portion 16 to retain the removable portion 26 in a closed configuration. In certain embodiments, the removable portion 26 advantageously comprises a plurality of ridges 40 to facilitate sliding the removable portion 26 relative to the lower portion 16 to allow the removable portion 26 to be removed. In other embodiments of the invention, the removable portion 26 may be configured without tabs or may be configured so as to be partially removable from the alarm system 10. For example, the removable portion 26 may be attached by a hinge to the lower portion 16 or to the remainder of the upper portion 14. In one embodiment, the removable portion 26 allows access to a power source 42 of the alarm system 10 when the removable portion 26 is at least partially removed.

Figure 3:
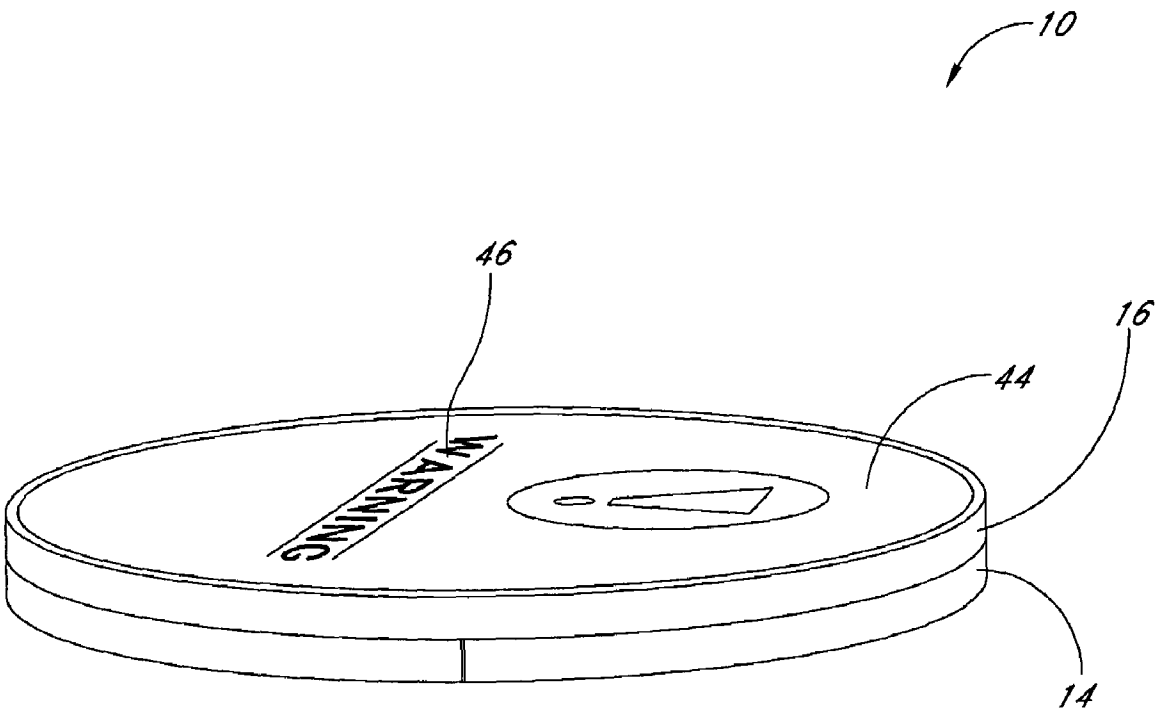
FIG. 3 illustrates a perspective view of the bottom side of one embodiment of the alarm system.

FIG. 3 illustrates a perspective view of the bottom of one embodiment of the alarm system 10. The lower portion 16 of the housing 12 preferably comprises a layer of adhesive 44 to facilitate mounting the alarm system 10. Such suitable adhesives are generally known in the art and may be applied directly to the lower portion 16 or may be provided by a suitable material, such as dual-sided sticky-backed tape. In one embodiment, the adhesive 44 of the lower portion 16 facilitates mounting the alarm system 10 to a window surface.

The lower portion 16 may also comprise a warning label 46. When the alarm system 10 is mounted to a window surface, the warning label 46 preferably is viewable from an opposite side of the window surface. In this respect, the warning label 46 serves as a deterrent by providing notification to would-be intruders that the area is secure and/or protected by the alarm system 10.

Figure 4:
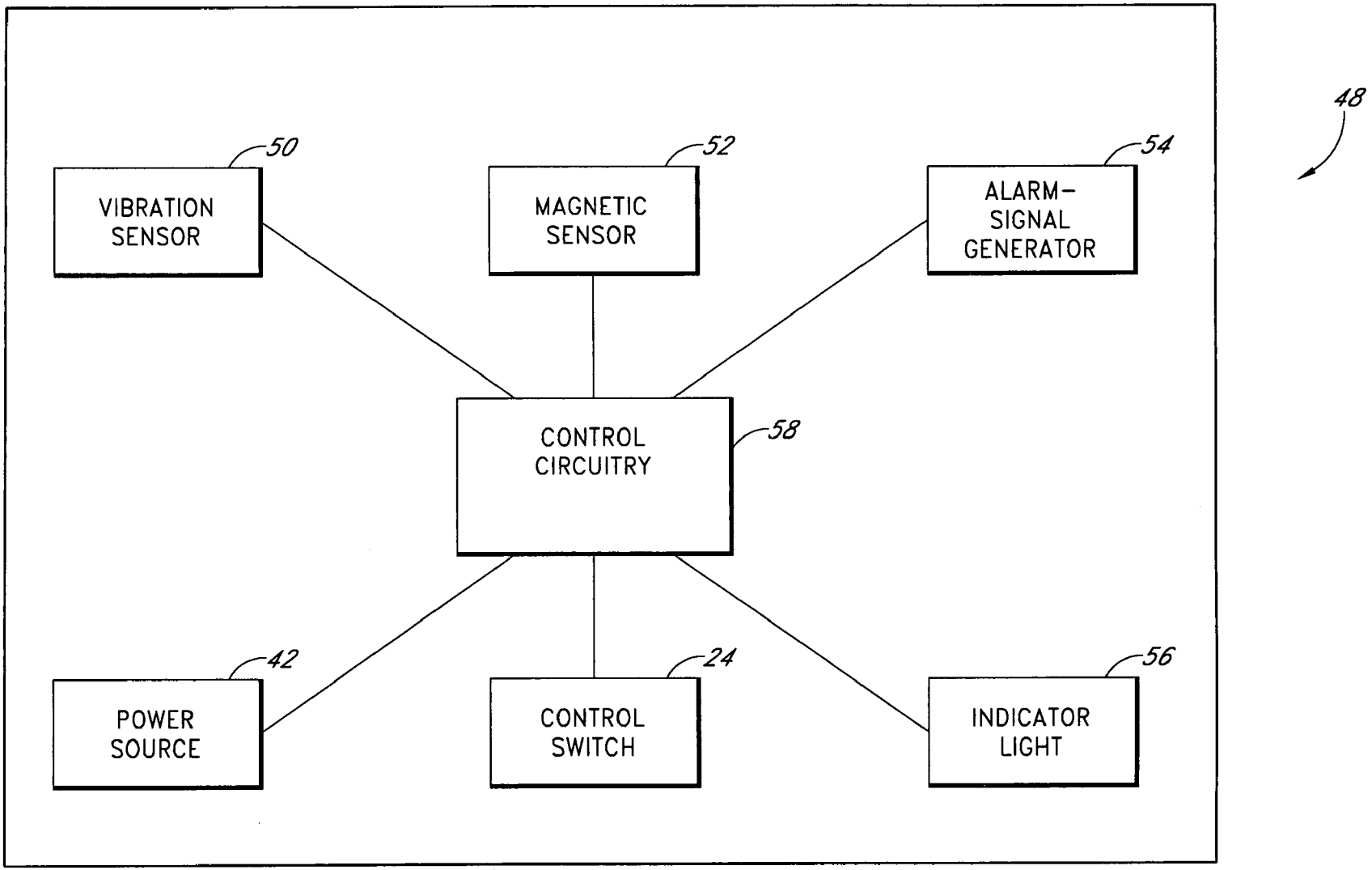
FIG. 4 illustrates a block diagram of alarm circuitry of the alarm system, according to one embodiment of the invention.

FIG. 4 illustrates a block diagram of one embodiment of an alarm circuitry 48 of the alarm system 10. The alarm circuitry 48 includes a vibration sensor 50, a magnetic sensor 52, an alarm-signal generator 54, the power source 42, the control switch 24, and an indicator light 56. The alarm circuitry 48 also comprises control circuitry 58 that is coupled to at least one of the other components of the alarm circuitry 48.

The vibration sensor 50 is configured to detect vibration or movement. For example, the vibration sensor 50 may detect movement or vibration of an apparatus to which the alarm system 10 is attached or which the alarm system 10 is configured to monitor, such as a window or a door. In other embodiments, the vibration sensor 50 senses vibration of the alarm system 10. The vibration sensor 50 preferably sends a signal to the control circuitry 58 upon detection of vibration. The control circuitry 58 then triggers the alarm-signal generator 54 to activate the alarm.

In one embodiment of the invention, the vibration sensor 50 comprises a piezoelectric material, which piezoelectric materials are known in the art. For example, the vibration sensor 52 may comprise a piezoelectric crystal. When the piezoelectric material is exposed to vibration (e.g., vibration of the alarm system 10), the piezoelectric material undergoes a compression or distortion and, as a result, produces an electric field. This electric field is then used in activating or in causing to activate the alarm-signal generator 54. In addition, certain piezoelectric materials vibrate when a particular voltage is applied to the material, which vibration results in a perceptible sound. Thus, the piezoelectric material can be advantageously used in sensing vibration (e.g., in the vibration sensor 50) and/or in generating an alarm signal (e.g., in the alarm-signal generator 54).

In one embodiment of the invention, the vibration sensor 50 outputs a signal to the control circuitry 58 if the magnitude of the vibration sensed is above a threshold amount. In other embodiments of the invention, the vibration sensor 50 outputs a signal that is based on characteristics of the vibration being sensed, and the control circuitry 58 determines whether the alarm-signal generator 54 should be activated. For example, vibrations of certain frequencies may be filtered out so that they do not activate the alarm-signal generator 54.

The magnetic sensor 52 preferably detects relative movement of the alarm system 10 with respect to another device. In one embodiment, the magnetic sensor 52 comprises a reed switch. The magnetic sensor 52 advantageously detects motion of the alarm system 10 toward or away from a signal-generating element (not shown). For example, the alarm system 10 having the magnetic sensor 52 may be located on a window while the signal-generating element is located on another surface, such as a second window, a window sill, or a window pane. In one embodiment, the signal-generating element causes an electromagnetic field that is detectable by the magnetic sensor 52. When the distance between the magnetic sensor 52 and the signal-generating element changes, the electromagnetic field at the magnetic sensor 52 also changes. The magnetic sensor 52 preferably is coupled to the control circuitry 58 and sends a signal to the control circuitry 58 upon detection of relative movement between the alarm system 10 and the signal-generating element. Upon detection of relative movement, the control circuitry 58 preferably triggers the alarm-signal generator 54 to activate the alarm.

In one embodiment, the signal-generating element comprises a permanent magnet and can be mounted to a metallic surface by magnetic force. The magnetic signal-generating element may also be marked to facilitate proper orientation of the alarm system 10 relative to the magnetic signal-generating element. In one embodiment of the invention, the magnetic signal-generating element and the alarm system 10 are located in close proximity to each other, such as within a few inches, during normal use.

It is contemplated that the alarm circuitry 48 may comprise more or fewer sensors than the two sensors depicted in FIG. 4. In addition, in other embodiments of the invention, other types of sensors may be used. For example, in one embodiment a sound sensor could be used to detect sounds that could trigger the alarm. In other embodiments, optical sensors may be used to detect motion. While embodiments have been described with exemplary types of sensors, any type or combination of sensors may be used. For example, the alarm system 10 may comprise a magnet, and an external magnetic sensor may be used to detect motion of the alarm system 10.

The alarm-signal generator 54 is configured to generate an alarm when triggered or activated by the control circuitry 58. The term "alarm-signal generator" as used herein is a broad term and is used in its ordinary sense and includes without limitation any device, component, apparatus, system or method of generating, causing, emitting or transmitting a signal that indicates the occurrence of some event or condition.

In one embodiment of the invention, the alarm-signal generator 54 generates or transmits an audible alarm upon being triggered by the control circuitry 58 in response to a signal received from one of the plurality of sensors 50, 52. For example, the alarm-signal generator 54 may comprise a speaker. In one embodiment, the alarm-signal generator 54 is configured to generate alarms at a plurality of decibel levels. For example, the alarm-signal generator 54 may generate an alarm at approximately 70 decibels. In other embodiments, the alarm-signal generator 54 generates an alarm at approximately 90 decibels, or more.

The power source 42 preferably provides power to the control circuitry 58 and to other components of the alarm circuitry 48. In one embodiment, the power source 42 comprises one or more batteries. For example, the power source 42 may comprise three 1.5-volt alkaline button cell batteries. In other embodiments, other types of batteries may be used, such as lithium ion batteries, solar cell batteries, and the like. In yet other embodiments of the invention, the power source 42 may comprise other types of devices or systems that can provide power to the alarm circuitry 48.

In certain embodiments, the power source 42 is accessed by removing the removable portion 26 of the alarm system 10 as described above. In some embodiments, the power source 42 may comprise a primary power source and a secondary power source, wherein the secondary power source preferably provides back-up power to the primary power source.

With continued reference to FIG. 4, the indicator light 56 provides an alert as to certain conditions of the alarm system 10. For example, the indicator light 56 may comprise a light-emitting diode (LED) that illuminates when the power source 42 is low. In certain embodiments, the indicator light 56 illuminates when the alarm system 10 is active and turns off when the alarm system 10 is inactive or has run out of power. In other embodiments, the indicator light 56 blinks when the power source 42 is low. In further embodiments of the invention, the alarm-signal generator 54 may chirp, or generate other audible sounds, when the power source 42 is low. As discussed above, the indicator light 56 is advantageously visible through the indicator opening 22 in the housing 12.

The control circuitry 58 is configured to communicate with the sensors 50, 52, the alarm-signal generator 54, the control switch 24, and the indicator light 56. The control circuitry 58 may be implemented in hardware, firmware, or and/or software. For example, the control circuitry 58 may comprise various logic gates coupled so as to perform the functions described above. The control circuitry 58 is advantageously powered by the power source 42.

In some embodiments, the alarm system 10 is a self-contained system with all components of the alarm circuitry 48 disposed or substantially contained within the housing 12. A self-contained alarm system 10 may be a stand-alone system or work in connection with a signal-generating element located outside of the housing 12. For example, in some embodiments, a self-contained alarm system 10 is a stand-alone system having all components of the alarm circuitry 48 substantially enclosed by the housing 12, and no interaction with a signal-generating element is needed for activation of the alarm. In other embodiments, a self-contained alarm system 10 has all the components of the alarm circuitry 48 located within the housing 12, and the alarm system 10 interacts with a signal-generating element located outside of the housing 12.

It is also contemplated that all the components of the alarm circuitry 48 need not be enclosed by the housing 12. For example, certain components of the alarm circuitry 48 may be located within the housing 12 and may communicate with other components of the alarm circuitry 48 that are located outside the housing 12. For example, in some embodiments, a sensor 50 or 52 of the alarm circuitry 48 may be located within the housing 12, while other components of the alarm circuitry 48, such as, for example, the alarm-signal generator 54, may be located outside of the housing 12. In other embodiments, components of the alarm circuitry 48 that are located in the housing 12 can be coupled to, or in communication with, a central alarm control system (not shown) having other components of the alarm circuitry 48. In yet other embodiments of the invention, a central alarm control system is advantageously coupled to, or in communication with, a plurality of alarm systems 10. In some embodiments, the alarm system 10 can be remotely activated or controlled.

The components of the alarm circuitry 48 can also be separated into multiple subcomponents or can be separated into multiple devices that reside at different locations and that communicate with each other, such as through wired or wireless communications (e.g., radio frequency communication). Multiple components may also be combined into a single component. It is also contemplated that the components described herein may be integrated into a fewer number of modules. One module may also be separated into multiple modules.

Figure 5:
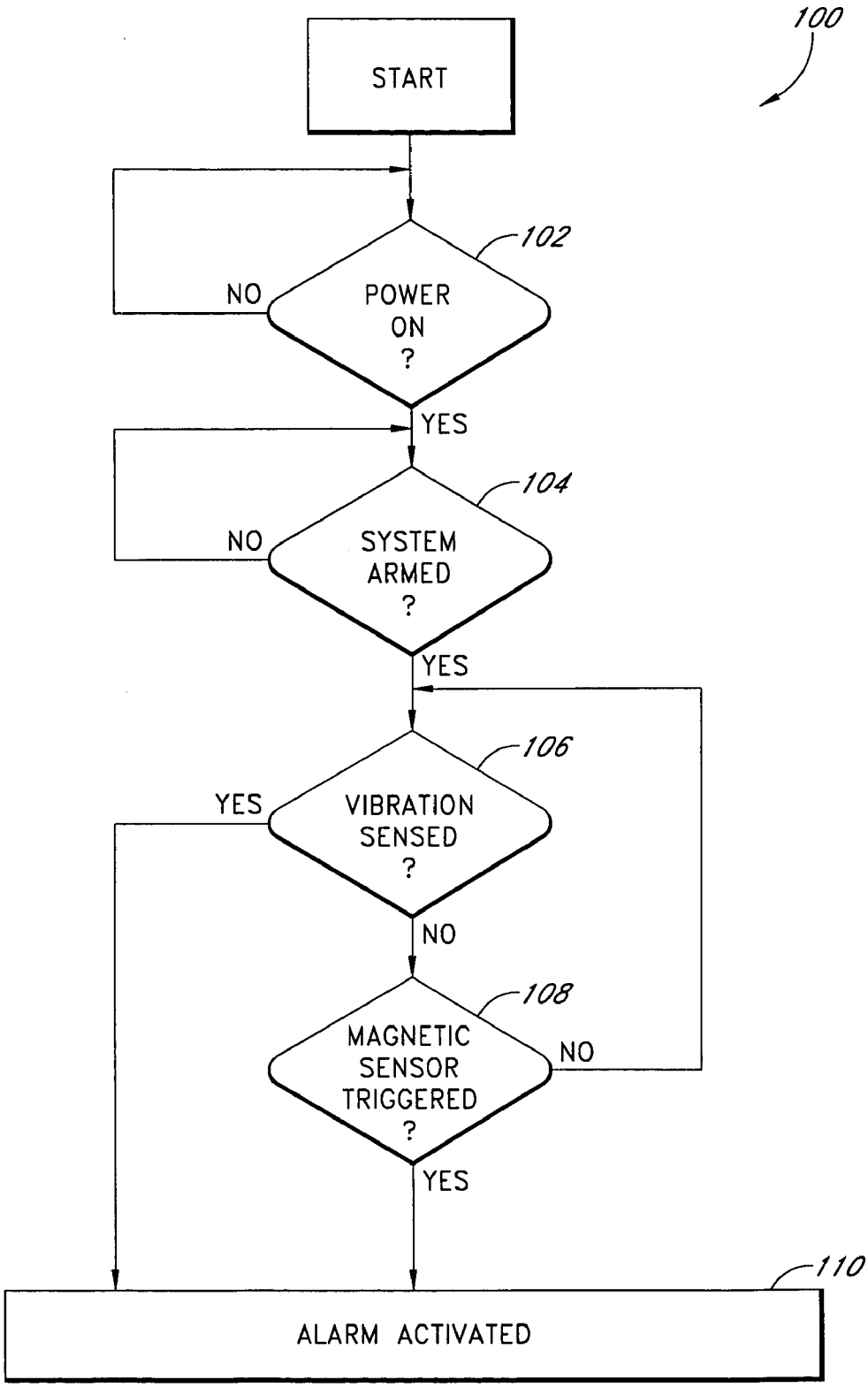
FIG. 5 illustrates a flow chart of one embodiment of an alarm process executed by the alarm system.

FIG. 5 illustrates a block diagram of an alarm process 100 for the alarm system 10 according to one embodiment of the invention. The alarm process 100 begins with State 102, wherein it is determined if the alarm system 10 is powered on. If the alarm system 10 is not powered on, the alarm process 100 remains in State 102. If the alarm system 10 is powered on, the alarm process 100 moves to State 104.

At State 104, it is determined whether the alarm system 10 is armed. In certain situations, a user of the alarm system 10 may want the alarm system 10 to be in an "unarmed" state. For example, a home user may want to open a window or a door without having the alarm system 10 trigger an alarm. In one embodiment of the invention, the control switch 24 allows the user to select an "unarmed" state. In other embodiments, the alarm system 10 may be preprogrammed to enter an armed or an unarmed state according to an established schedule. For example, the alarm system 10 may automatically enter an armed state at a certain time each day, such as at 11:00 P.M.

If the alarm system 10 is not in an armed state, the alarm process 100 remains in State 104. If the alarm system 10 is armed, the alarm process 100 moves to a State 106. At State 106, the alarm process 100 determines if the alarm system 10 senses vibration. For example, the vibration sensor 50 may be used to sense vibration of the alarm system 10 or vibration of an object being monitored.

If vibration is sensed, the alarm process 100 moves to a State 110, wherein an alarm is activated. The alarm may comprise any signal, notification, or output that indicates that the alarm system 10 has been triggered. In one embodiment, the alarm comprises an audible alert, such as a loud noise. In other embodiments, the alarm comprises a visual alert, such as a flashing light. In yet other embodiments, the alarm comprises a signal that is sent to a monitoring system or device that records the signal and manages or coordinates a response, such as the dispatching of persons to the site of the triggered alarm system 10. Multiple alarms may also be activated that comprise at least one of the above-described alarms or that comprise other devices or methods for emitting an alert.

If no vibration is sensed, the alarm process 100 moves to a State 108, wherein it is determined if the magnetic sensor is triggered. In one embodiment, the alarm system 10 comprises the magnetic sensor 52, which is triggered by certain motions or movements, as described above. If the magnetic sensor is triggered, then the alarm process 100 moves to State 110 and activates the alarm. If the magnetic sensor is not triggered, the alarm process 100 returns to State 106 to monitor for vibration.

Embodiments of the alarm system 10 are able to be used in a variety of locations or to monitor a variety of objects. For example, in one embodiment, the alarm system 10 is configured to mount or attach to a window surface. In such an embodiment, a securing material, such as the adhesive 44, allows for the lower portion 16 of the alarm system 10 to easily mount to the window surface. As a result, physical modifications, such as the drilling of holes or the insertion of screws or nails, to the window or window assembly (e.g., window sill) are not needed to install the alarm system 10. In one embodiment, the thin profile of the alarm system 10, allows for the alarm system 10 to be mounted to a window without obstructing the functioning (e.g., sliding) of the window, an associated screen, or another associated window.

Figure 6B:
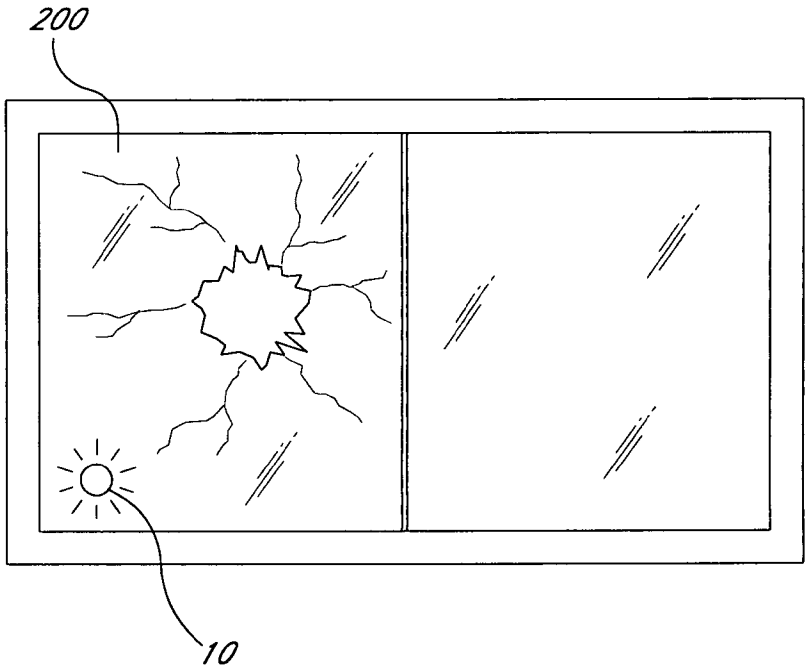
FIGS. 6A and 6B illustrate elevational views of a window assembly and the alarm system, according to one embodiment of the invention.
Figure 6A:
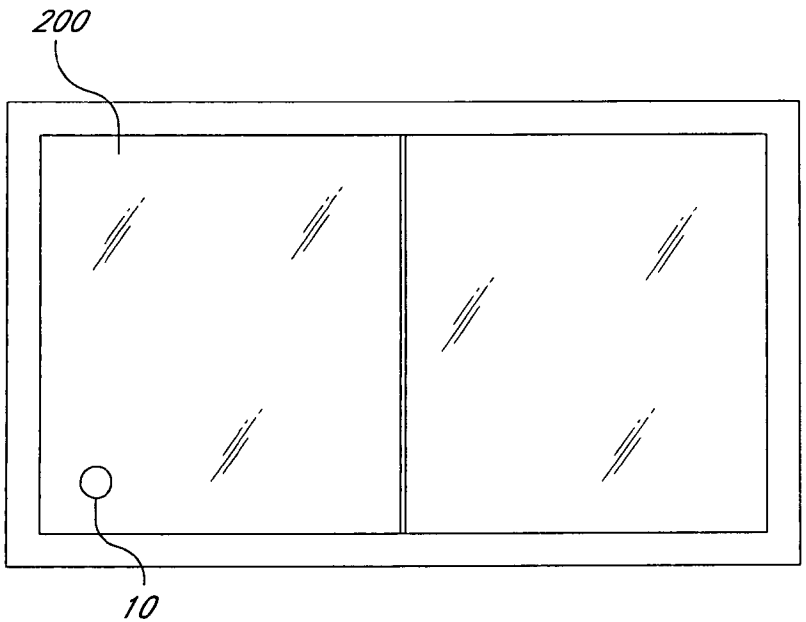

FIGS. 6A and 6B illustrate one method of monitoring a window assembly utilizing embodiments of the alarm system 10 that sense vibration. As illustrated, the alarm system 10 is affixed to a stationary window 200. In one embodiment, the alarm system 10 is affixed with an adhesive or other material as described previously. Using an adhesive allows for the alarm system 10 to be easily attached to the window 200 without the need for extra tools and without requiring a substantial amount of time or effort to complete the installation process.

When the alarm system 10 is armed, or in the state of monitoring the window, vibrations of the widow 200 may cause the alarm system 10 to activate an alarm. For example, FIG. 6B illustrates the window 200 being broken, such as by a rock or a would-be intruder. The vibrations resulting from the breaking of the window 200 are sensed by the alarm system 10, and as a result, the alarm is activated.

Figure 7B:
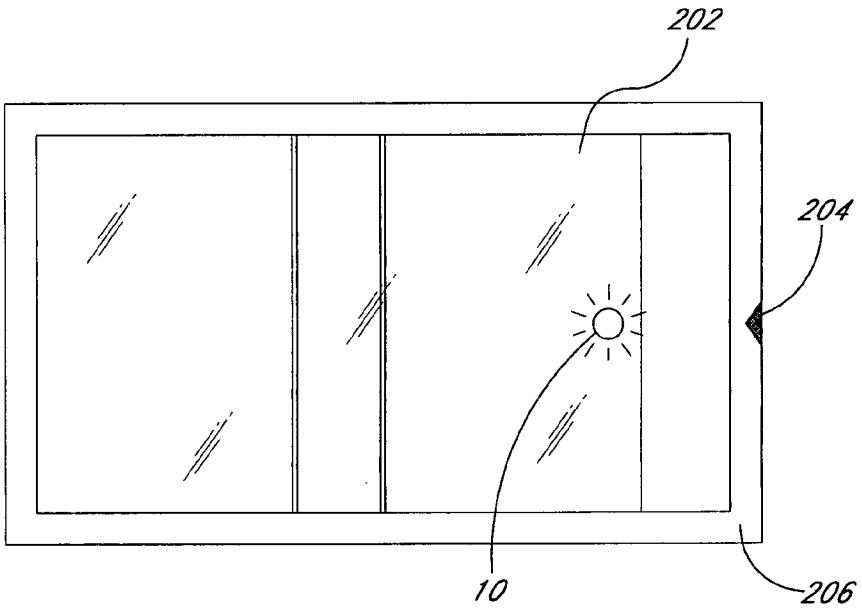
FIGS. 7A and 7B illustrate elevational views of a window assembly and the alarm system, according to another embodiment of the invention.
Figure 7A:
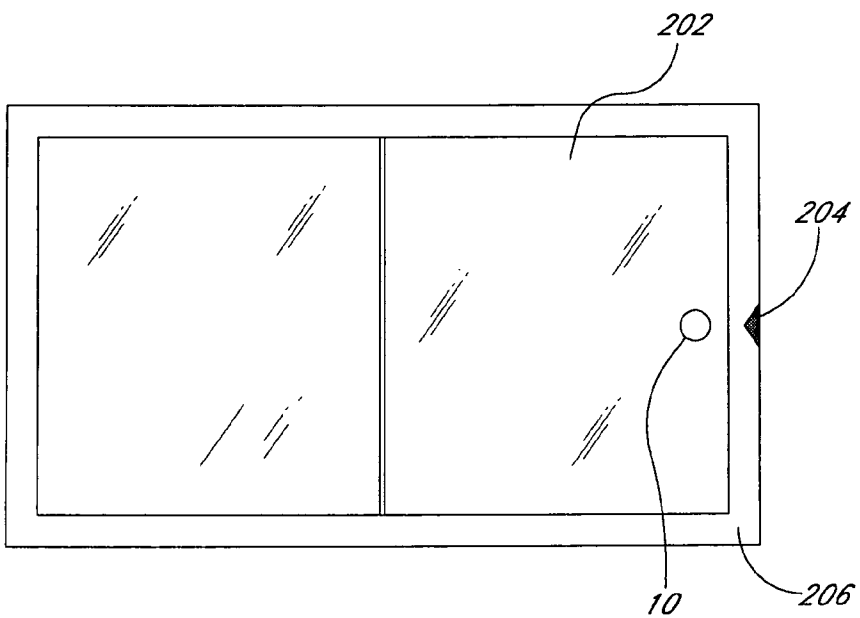

FIGS. 7A and 7B illustrate one method of monitoring a window assembly utilizing embodiments of the alarm system 10 that sense movement. For example, such embodiments of the alarm system 10 may comprise the magnetic sensor 52. As illustrated, the alarm system 10 is affixed to a moveable window 202. In one embodiment, the alarm system is affixed with an adhesive or other like material. A signal-generating element 204 is affixed or mounted to a stationary surface 206. The signal-generating element 204 may comprise a magnet or other type of device that is capable of emitting and/or receiving a signal, as was discussed previously. The stationary surface 206 may comprise any apparatus, object or device that normally remains in a fixed position, such as a window pane, a wall, or a stationary window.

When the alarm system 10 is armed, or in the state of monitoring the window, movement of the alarm system 10 away from or toward the signal-generating element 204 causes the alarm system 10 to activate an alarm. In other embodiments, movement of the signal-generating element 204 away from or toward the alarm system 10 activates an alarm. For example, FIG. 7B illustrates the moveable window 202 being slid away from the signal-generating element 204, which is affixed to the stationary surface 206. This movement is sensed by the alarm system 10, and as a result, an alarm is activated.

Figure 8B:
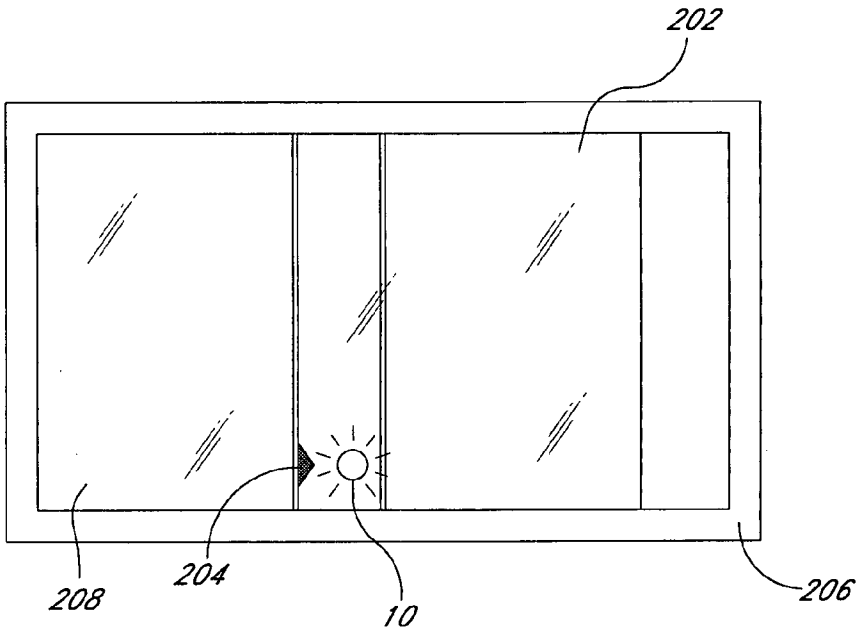
FIGS. 8A and 8B illustrate elevational views of a window assembly and the alarm system, according to yet another embodiment of the invention.
Figure 8A:
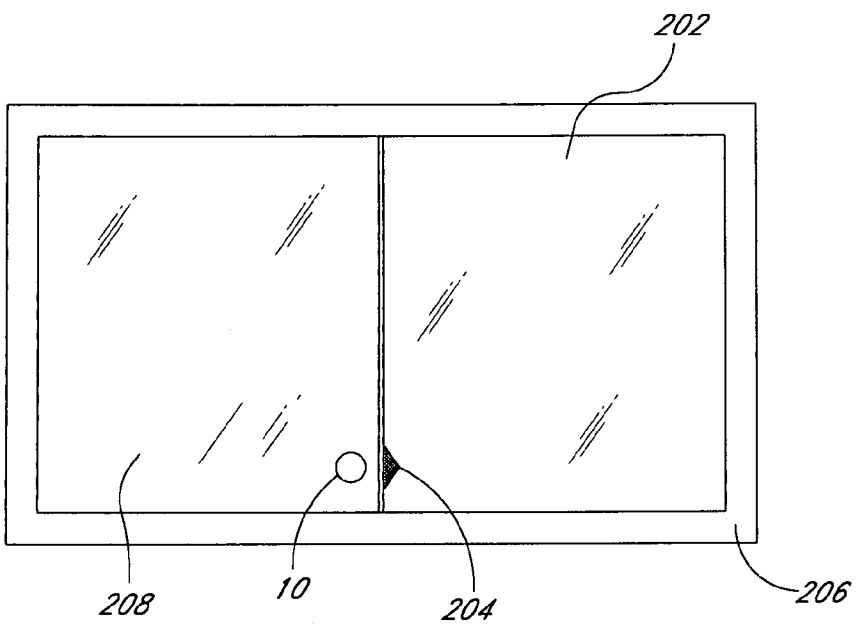

FIGS. 8A and 8B illustrate another method of monitoring a window assembly utilizing embodiments of the alarm system 10 that sense movement. As illustrated, the alarm system 10 is affixed to a second window 208, and the signal-generating element 204 is affixed to the moveable window 202. When the alarm system 10 is armed, and the moveable window 202 is opened or moved, the alarm system 10 activates an alarm, as is illustrated in FIG. 8B. In other embodiments, the alarm system 10 may be affixed to the moveable window 202, and the signal-generating element may be affixed to the second window 208.

Figure 9:
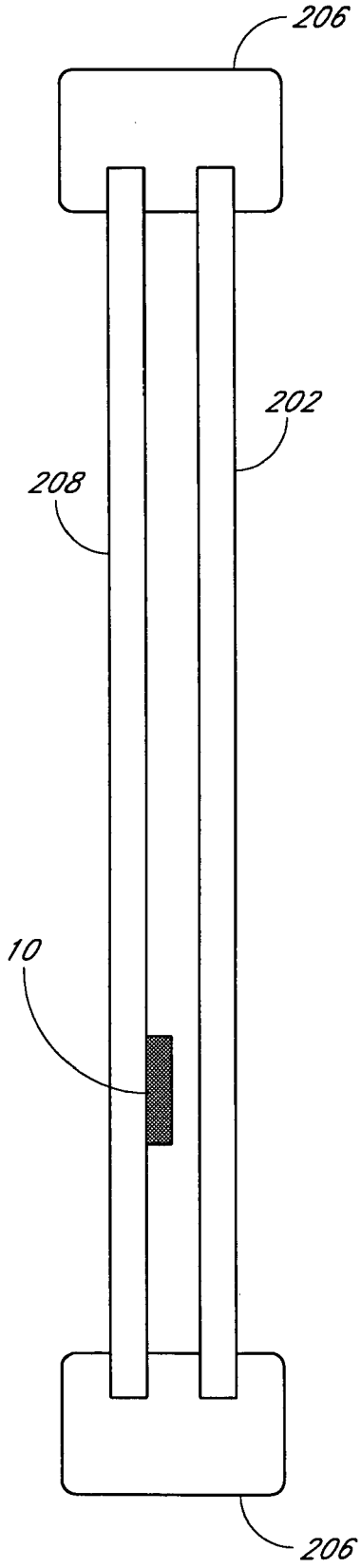
FIG. 9 illustrates a side view of one embodiment of the alarm system being positioned between two window surfaces.

FIGS. 8A and 8B also illustrate one of the advantages of embodiments of the alarm system 10 having a thin profile. The thin profile of the alarm system housing 12 allows the moveable window 202 to slide past the second window 208, and other structures, without obstruction, while the alarm system 10 is attached to the second window 208. As illustrated in FIG. 9, in one embodiment, the thin-profile housing 12 allows for the alarm system 10 to fit between two windows, such as the moveable window 202 and the second window 208, having surfaces that are in approximately parallel planes.

While certain embodiments of the inventions have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions.

What is claimed is:

1. An alarm system comprising:

a vibration sensor configured to sense vibration of the alarm system and configured to output a first signal upon sensing said vibration;

a magnetic sensor configured to sense changes in distance between the alarm system and a signal-generating device and configured to output a second signal upon sensing said changes in distance;

a speaker;

control circuitry coupled to the vibration sensor, to the magnetic sensor, and to the speaker, wherein said control circuitry is configured to cause an audible alarm through said speaker in response to receiving said first signal or said second signal; and a housing substantially enclosing the vibration sensor, the magnetic sensor, the speaker, and the control circuitry, wherein said housing comprises a thin profile and is attachable to a first window surface such that said housing is capable of being located between the first window surface and a second window surface upon relative motion between the first window surface and the second window surface.

2. The alarm system of claim 1, wherein said housing has a profile of about 0.5 inch or less.

3. The alarm system of claim 1, wherein said housing has a profile of about 0.375 inch or less.

4. The alarm system of claim 1, wherein said housing has a profile of about 0.25 inch or less.

5. The alarm system of claim 1, further comprising an adhesive layer for attaching a lower portion of said housing to said first window surface.

6. The alarm system of claim 1, wherein said speaker is configured to emit an audible alarm of at least 70 decibels.

7. The alarm system of claim 1, further comprising a switch configured to select between at least an active state of said alarm system and an inactive state of said alarm system.

8. The alarm system of claim 1, wherein the housing is further configured to substantially enclose a power supply of said alarm system.

* * * * *

US007187280C1

(12) EX PARTE REEXAMINATION CERTIFICATE (7463rd)

United States Patent

Ko

(10) Number: US 7,187,280 C1

(45) Certificate Issued: Apr. 20, 2010

(54) ALARM SYSTEM WITH THIN PROFILE

(75) Inventor: Joseph Y. Ko, Laguna Niguel, CA (US)

(73) Assignee: Techko, Inc., Irvine, CA (US)

Reexamination Request:
No. 90/009,408, Mar. 25, 2009

Reexamination Certificate for:

| | |
|---|---|
| Patent No.: | **7,187,280** |
| Issued: | **Mar. 6, 2007** |
| Appl. No.: | **10/903,330** |
| Filed: | **Jul. 30, 2004** |

Related U.S. Application Data

(60) Provisional application No. 60/491,391, filed on Jul. 31, 2003.

(51) Int. Cl.

| | |
|---|---|
| ***G08B 13/08*** | (2006.01) |
| ***G08B 19/00*** | (2006.01) |
| ***G08B 23/00*** | (2006.01) |

(52) U.S. Cl. ..... 340/545.2; 340/547; 340/521; 340/693.5

(58) Field of Classification Search ..... None
See application file for complete search history.

(56) References Cited

U.S. PATENT DOCUMENTS

| | | | |
|---|---|---|---|
| 5,473,310 | A | 12/1995 | Ko |
| 5,594,418 | A | 1/1997 | Martin |
| 6,417,770 | B1 | 7/2002 | Sturznickel |
| 6,989,746 | B2 | 1/2006 | Rasmussen |
| 6,993,585 | B1 | 1/2006 | Starkovich et al. |

FOREIGN PATENT DOCUMENTS

| | | |
|---|---|---|
| JP | 3087940 | 8/2002 |

*Primary Examiner*—Colin M Larose

(57) ABSTRACT

An alarm system includes a housing that substantially encloses a plurality of sensors and an alarm-signal generator. The housing has a thin profile and may be mountable in various locations, such as on a window surface. The thin profile of the housing allows the alarm system to be attached to the surface of a first window and capable of being located between the first window surface and a second window surface upon relative motion between the first window surface and the second window surface.

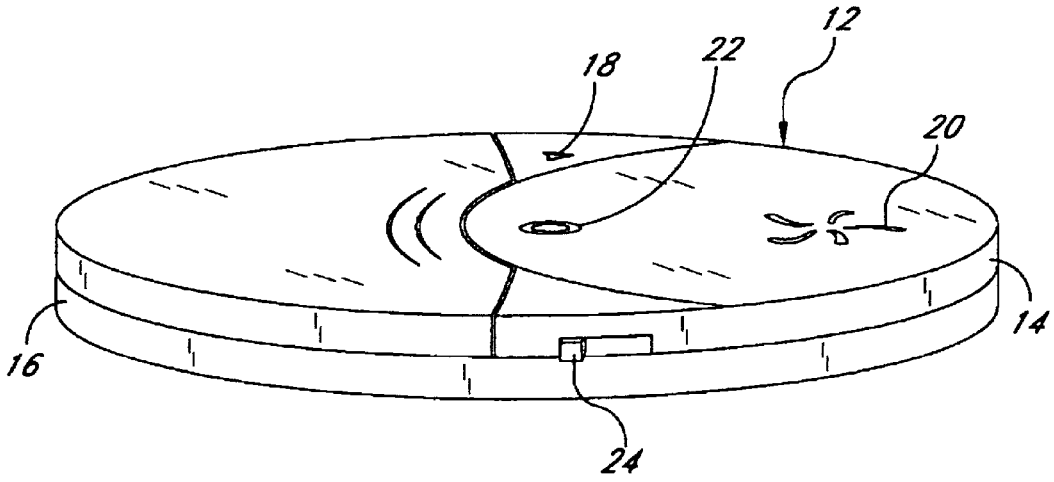

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–8 is confirmed.

* * * * *